US011637393B2

(12) United States Patent
Iga

(10) Patent No.: US 11,637,393 B2
(45) Date of Patent: Apr. 25, 2023

(54) ELECTRICAL CONNECTOR WITH STRUCTURE FOR PREVENTING INFLOW OF COATING

(71) Applicant: HIROSE ELECTRIC CO., LTD., Kanagawa (JP)

(72) Inventor: Junya Iga, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 3 days.

(21) Appl. No.: 17/231,586

(22) Filed: Apr. 15, 2021

(65) Prior Publication Data

US 2021/0336368 A1 Oct. 28, 2021

(30) Foreign Application Priority Data

Apr. 27, 2020 (JP) ..... JP2020-078065

(51) Int. Cl.
*H01R 13/405* (2006.01)
*H01R 12/75* (2011.01)
(Continued)

(52) U.S. Cl.
CPC ..... *H01R 13/405* (2013.01); *H01R 12/75* (2013.01); *H01R 13/6594* (2013.01);
(Continued)

(58) Field of Classification Search
CPC .. H01R 13/405; H01R 12/75; H01R 13/6594; H01R 43/24; H01R 12/724; H01R 12/57
See application file for complete search history.

(56) References Cited

U.S. PATENT DOCUMENTS 6,000,968 A 12/1999 Hagiwara
10,522,955 B2 12/2019 Smith et al.
(Continued)

FOREIGN PATENT DOCUMENTS

EP 3490078 A1 5/2019
JP 11-86975 A 3/1999
(Continued)

OTHER PUBLICATIONS

Extended European Search Report (EESR) dated Sep. 16, 2021 for corresponding European Patent Application No. 21169845.1.
(Continued)

*Primary Examiner* — Abdullah A Riyami
*Assistant Examiner* — Justin M Kratt
(74) *Attorney, Agent, or Firm* — Rankin, Hill & Clark LLP

(57) ABSTRACT

An electrical connector includes: an insulating spacer formed including an insulating material; a shell formed including a conductive material, the shell being configured to cover at least a part of the insulating spacer; and a plurality of terminals configured to be held by the insulating spacer. Each of the plurality of terminals includes a contact portion that contacts a terminal of a counterpart connector, and a board connection portion that is connected to a circuit on a board where the electrical connector is mounted, and the insulating spacer includes a cavity for preventing the inflow of a coating along a surface facing the board, between the board connection portion and the contact portion in the surface facing the board.

11 Claims, 5 Drawing Sheets

(51) Int. Cl.

| | |
|---|---|
| ***H01R 13/6594*** | (2011.01) |
| ***H01R 43/24*** | (2006.01) |
| *H01R 12/72* | (2011.01) |
| *H01R 12/57* | (2011.01) |

(52) U.S. Cl.
CPC ..... *H01R 43/24* (2013.01); *H01R 12/57* (2013.01); *H01R 12/724* (2013.01)

(56) References Cited

U.S. PATENT DOCUMENTS

| | | | | |
|---|---|---|---|---|
| 10,965,054 | B2 | 3/2021 | Naganuma | |
| 2005/0118876 | A1* | 6/2005 | Niitsu ..... | H01R 13/6474 439/626 |
| 2012/0231675 | A1 | 9/2012 | Zhang | |
| 2017/0244204 | A1 | 8/2017 | Smith et al. | |
| 2017/0271809 | A1 | 9/2017 | Fujii | |
| 2018/0090887 | A1 | 3/2018 | Little et al. | |
| 2019/0237898 | A1 | 8/2019 | Naganuma | |

FOREIGN PATENT DOCUMENTS

| | | |
|---|---|---|
| JP | 2014-116223 | 6/2014 |
| WO | 2016/039744 A1 | 3/2016 |

OTHER PUBLICATIONS

Japanese Office Action (JPOA) dated Mar. 20, 2023, for the corresponding Japanese Patent Application No. 2020-078065 and its English machine translation.

* cited by examiner

ELECTRICAL CONNECTOR WITH STRUCTURE FOR PREVENTING INFLOW OF COATING

CROSS-REFERENCE TO RELATED APPLICATION

This application claims priority from Japanese Patent Application No. 2020-078065 filed with the Japan Patent Office on Apr. 27, 2020, the entire content of which is hereby incorporated by reference.

BACKGROUND

1. Technical Field

An aspect of the present disclosure relates to an electrical connector.

2. Related Art

In electronic equipment such as personal computers, mobile information terminals, and mobile phones, an electrical connector that electrically connects an electrical cable to board wiring is used to connect the cable to, for example, a printed wiring board. In such an electrical connector, one connector (a board-side connector) is mounted on the board. The other connector (a cable-side connector) is connected to the cable. These connectors are mated to each other to electrically connect a signal wire of the cable and the wiring on the board.

Examples of a technology related to such an electrical connector mounted on a board include a technology described in JP-A-11-86975. An electrical connector described in JP-A-11-86975 is a surface mount connector socket that includes a shield cover formed by bending a metal plate, and a housing mated to the shield cover, and is mounted by soldering on a printed wiring board.

SUMMARY

An electrical connector includes: an insulating spacer formed including an insulating material; a shell formed including a conductive material, the shell being configured to cover at least a part of the insulating spacer; and a plurality of terminals configured to be held by the insulating spacer. Each of the plurality of terminals includes a contact portion that contacts a terminal of a counterpart connector, and a board connection portion that is connected to a circuit on a board where the electrical connector is mounted, and the insulating spacer includes a cavity for preventing the inflow of a coating along a surface facing the board, between the board connection portion and the contact portion in the surface facing the board.

DETAILED DESCRIPTION

Figure 1:
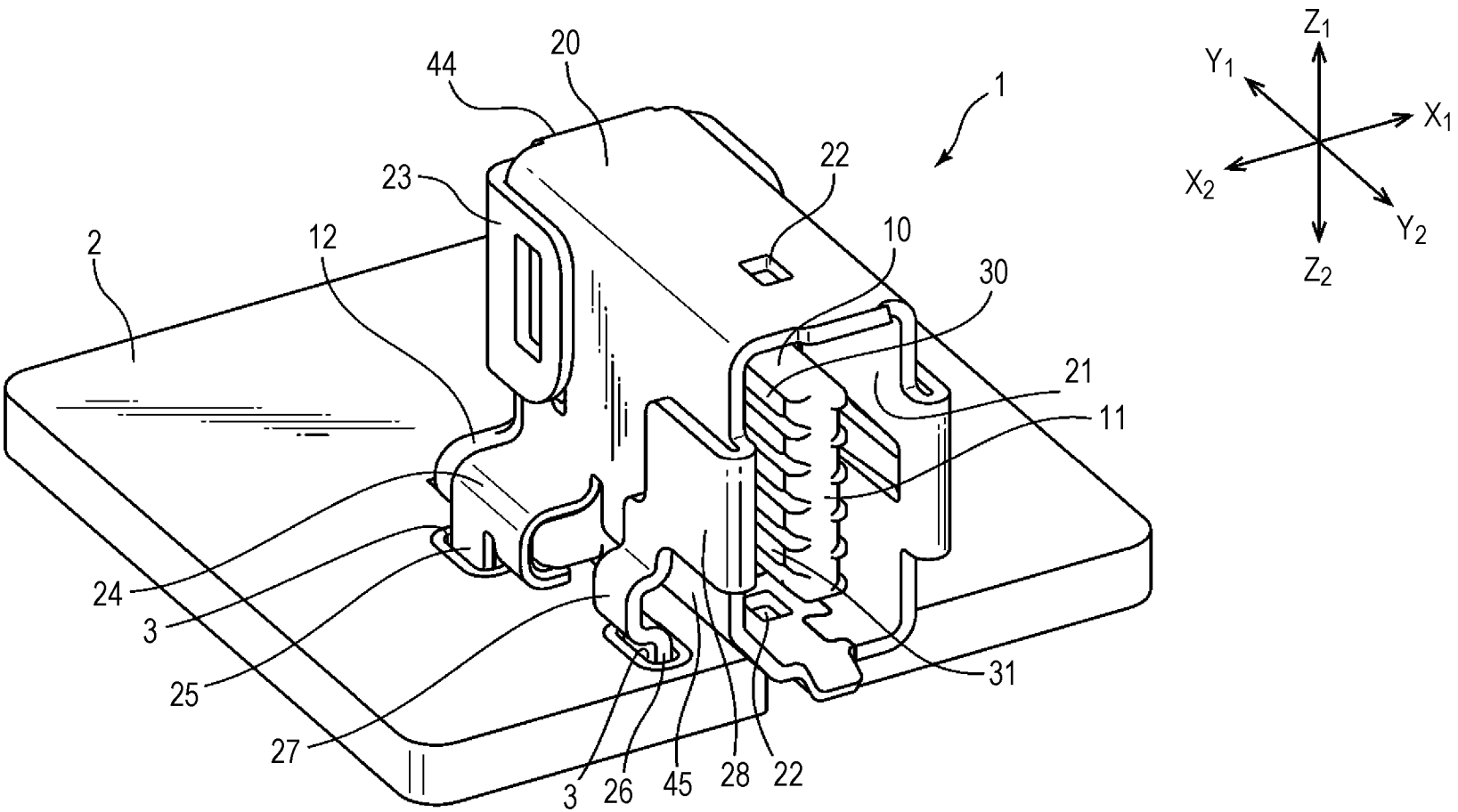
FIG. 1 is a perspective view illustrating the configuration of an electrical connector according to one embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In such electronic equipment as described above, downsizing and higher pin counts has progressed to improve portability. In step with downsizing and higher pin counts, a terminal pitch (an interval between terminals) of an electrical connector is also being reduced. A terminal pitch between board connection portions of terminals is also being reduced in, for example, an electrical connector that is mounted on a board. Hence, after the electrical connector is mounted on the board, a coating such as liquid resin being an insulating material is applied onto the board to prevent a short between the terminals and to improve insulation between the terminals. The coating is applied with, for example, a spray or brush. The coating is applied and then cured to form a resin layer on the board.

However, there is a slight gap between the electrical connector and the board. Hence, when the coating is applied to a terminal mounting portion on the board, a capillary phenomenon in the gap may cause the coating to move along the surface of the board and flow into a mating space (mating port) of the electrical connector. If the coating flows into the mating space (mating port), the adhesion of the coating to a terminal contact portion inside the mating space (mating port) and to an inner wall of the mating space may cause a contact failure between a terminal of one connector and a terminal of the other connector and a failure in the mating of the one connector and the other connector.

One object of the present disclosure is to provide a technology that can prevent the inflow of a coating into a mating space, the technology being related to an electrical connector that is mounted on a board.

The above-mentioned and other objects and novel features of the present disclosure will be clear from the description of the specification and the accompanying drawings.

A brief description of an outline of a representative example among examples disclosed in the present application is as follows:

Specifically, an electrical connector according to the representative example is an electrical connector which includes: an insulating spacer formed including an insulating material; a shell formed including a conductive material, the shell being configured to cover at least a part of the insulating spacer; and a plurality of terminals configured to be held by the insulating spacer. Each of the plurality of terminals includes a contact portion that contacts a terminal of a counterpart connector, and a board connection portion that is connected to a circuit on a board where the electrical connector is mounted, and the insulating spacer includes a cavity for preventing the inflow of a coating along a surface facing the board, between the board connection portion and the contact portion in the surface facing the board.

A brief description of an effect obtained by the representative example among the examples disclosed in the present application is as follows:

It is possible to prevent the inflow of the coating into a mating space of the connector when the coating is applied to the board connection portion of the terminal.

An embodiment of the present disclosure is described hereinafter in detail with reference to the drawings. The same reference numerals are assigned in principle to the same members in all the drawings for explaining the embodiment, and repeated descriptions thereof are omitted.

In the following embodiment, a plurality of divided sections or embodiments is described for convenience if necessary. They are not irrelevant to each other unless explicitly specified otherwise. In other words, one of them is a part or whole of a modification, details, a supplementary explanation, or the like of the other. Moreover, if a specific number is mentioned as, for example, the number (including quantity, numerical value, amount, and range) of elements in the following embodiment, for example, the number of elements is not limited to the specific number and may be equal to or greater than, or equal to or less than, the specific number unless explicitly specified otherwise, or unless in theory clearly limited to the specific number.

Figure 2:
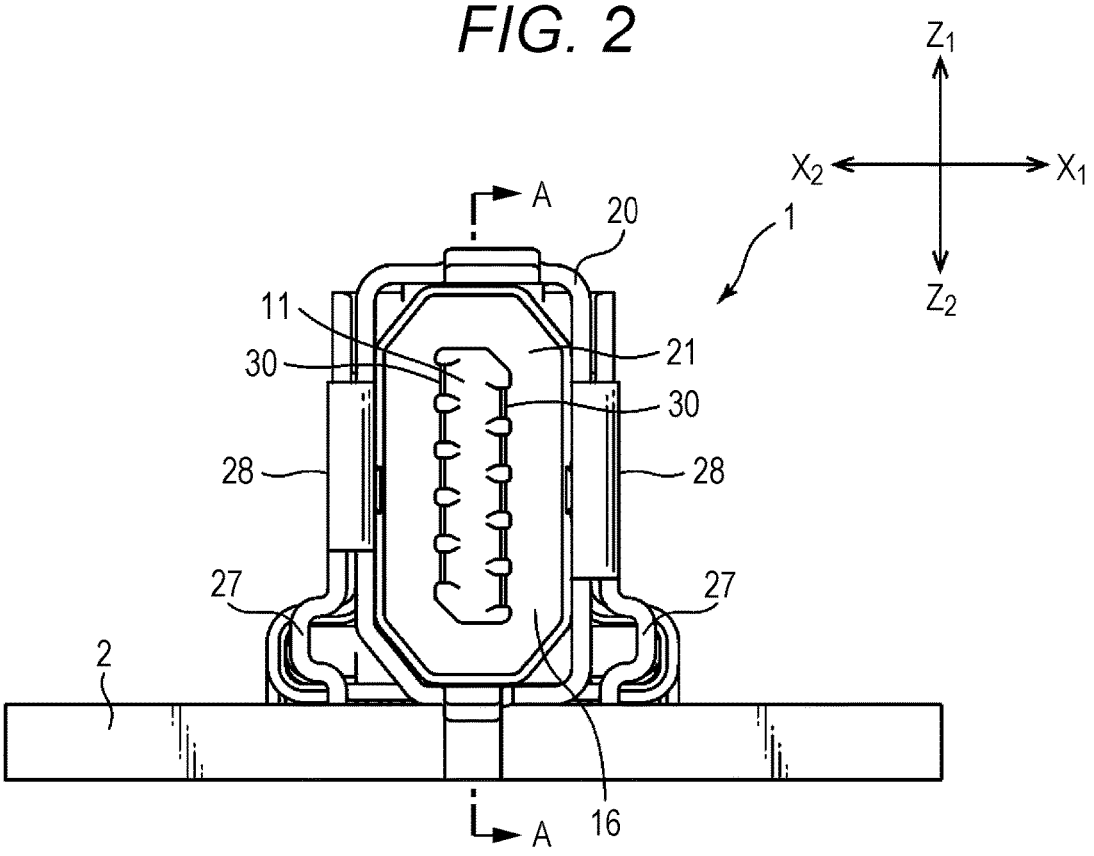
FIG. 2 is a front view illustrating the configuration of the electrical connector according to the one embodiment of the present disclosure.
Figure 3:
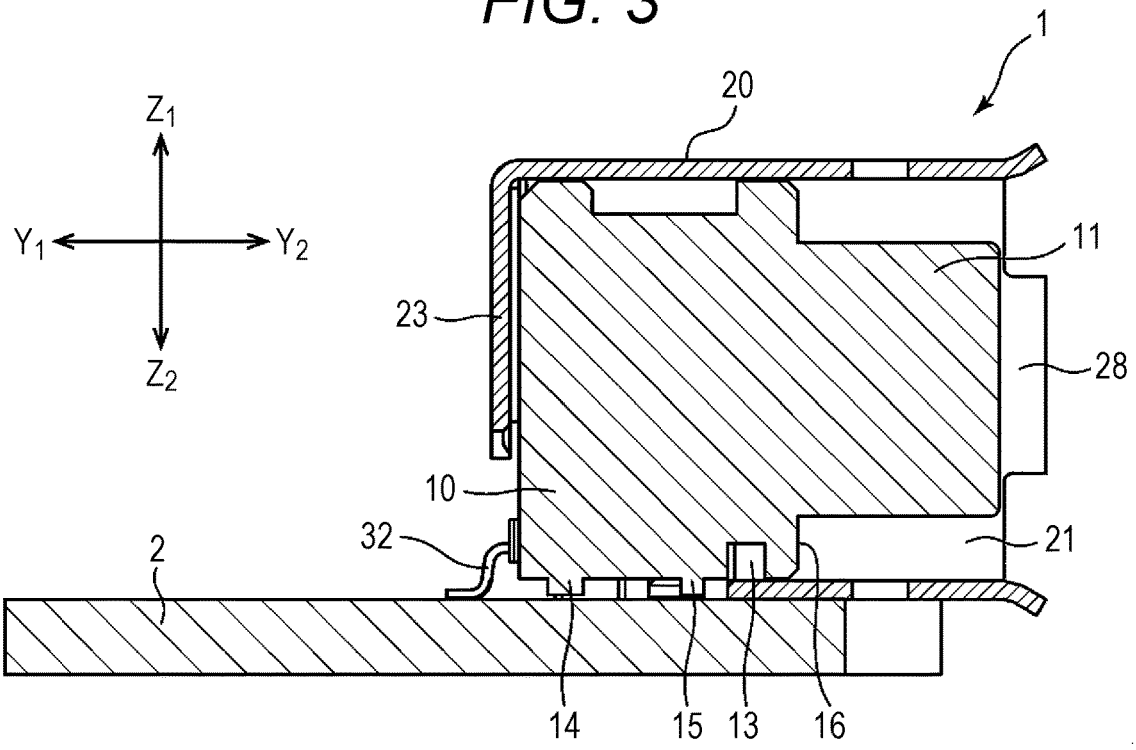
FIG. 3 is a cross-sectional view of a section taken along A-A in FIG. 2.
Figure 4:
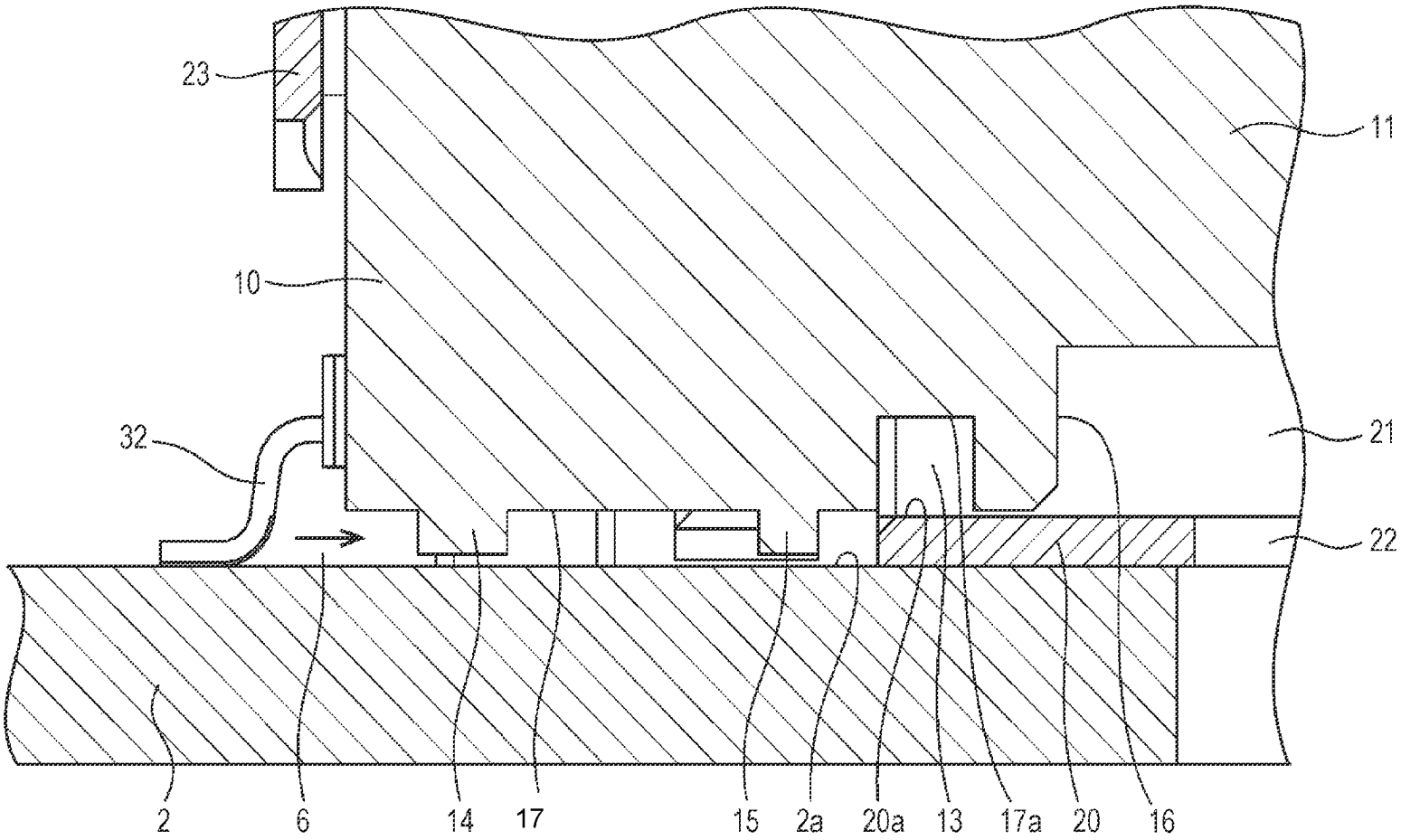
FIG. 4 is a partial enlarged view of FIG. 3.
Figure 5:
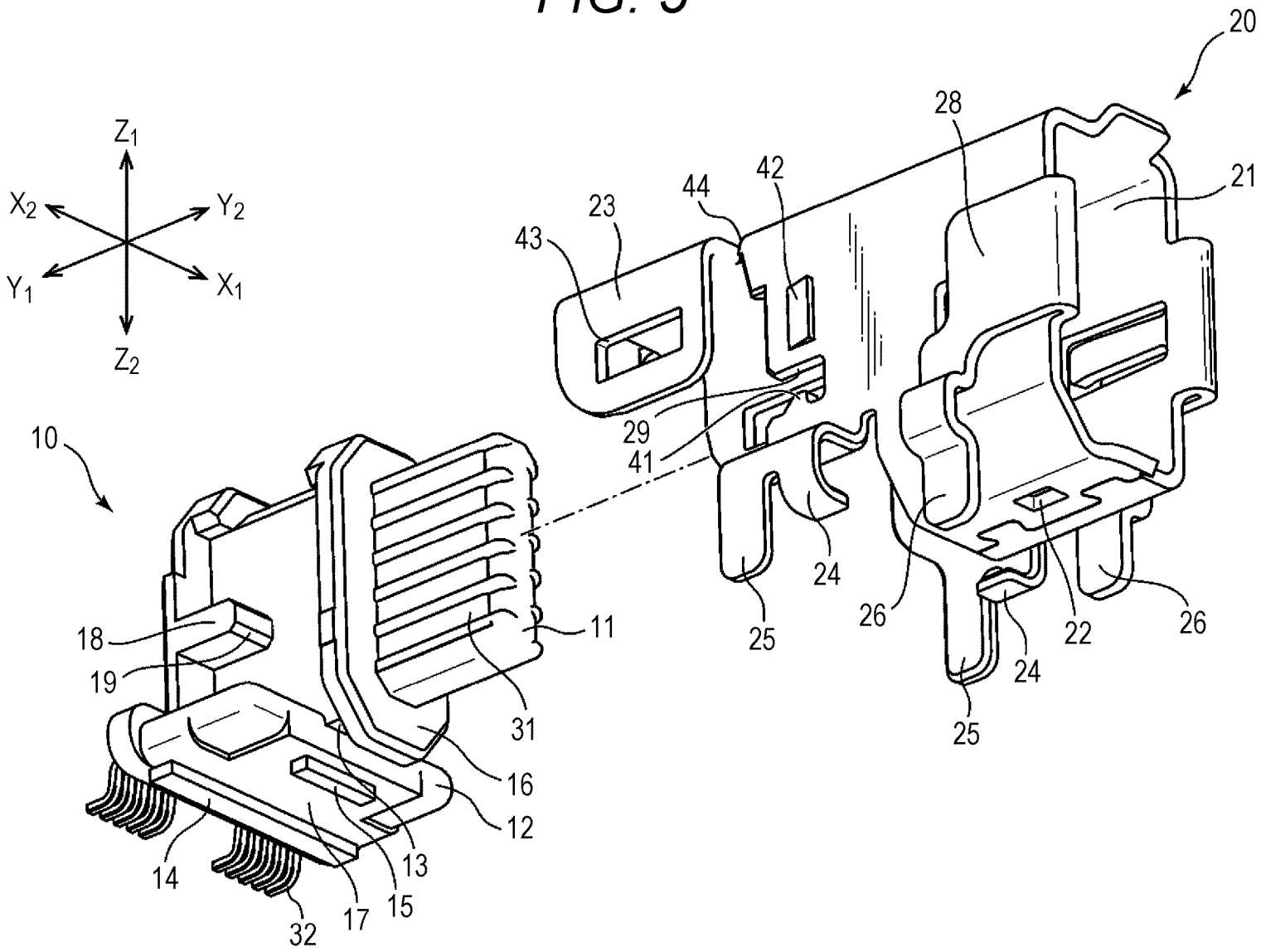
FIG. 5 is an exploded perspective view of the electrical connector according to the one embodiment of the present disclosure.
Figure 6:
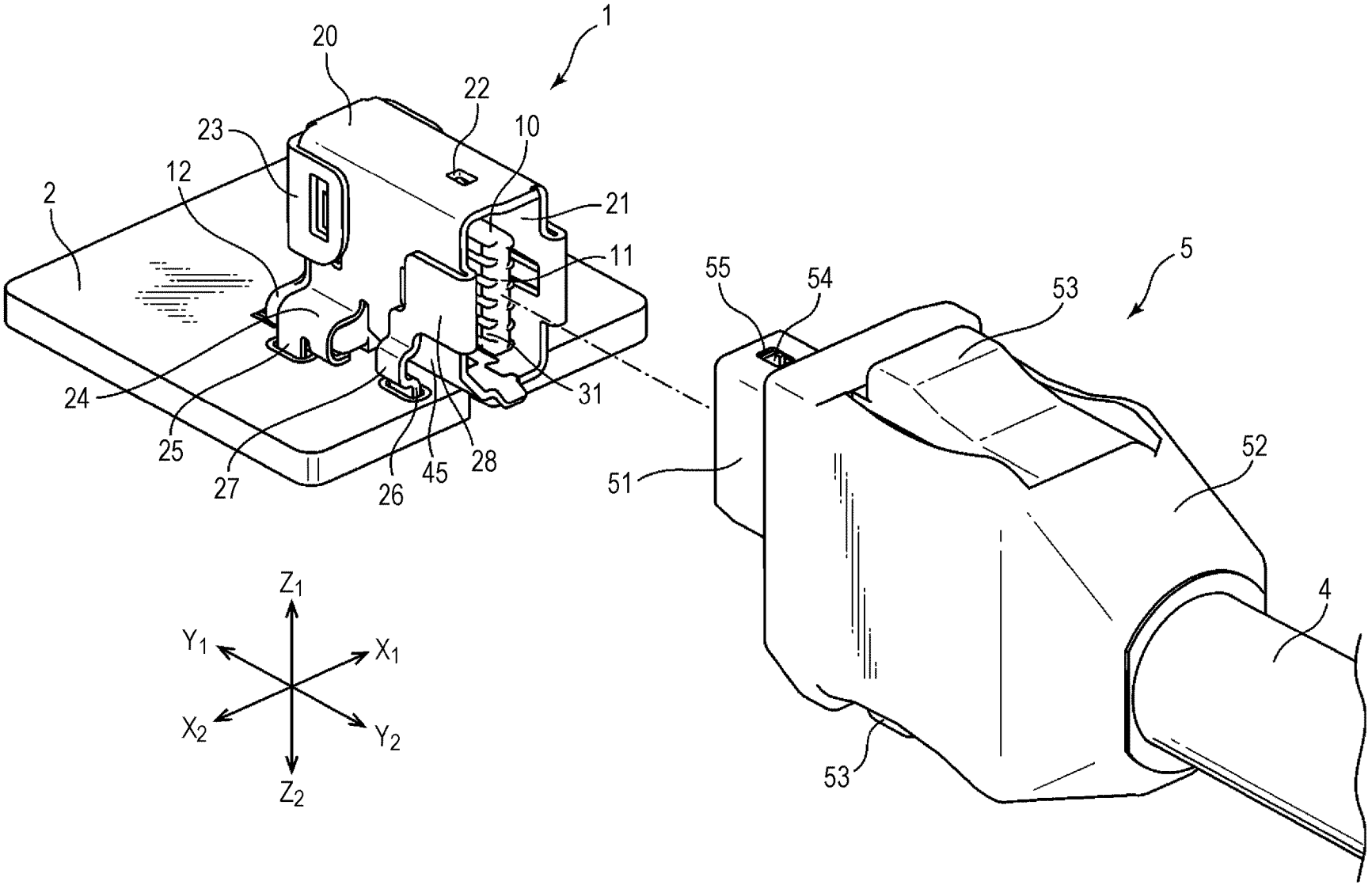
FIG. 6 is a perspective view illustrating the configurations of the electrical connector and a counterpart connector according to the one embodiment of the present disclosure.

FIG. 1 is a perspective view illustrating the configuration of an electrical connector according to the embodiment. FIG. 2 is a front view illustrating the configuration of the electrical connector according to the embodiment. FIG. 3 is a cross-sectional view of a section taken along A-A in FIG. 2. FIG. 4 is a partial enlarged view of FIG. 3. FIGS. 1 to 4 illustrate the electrical connector in a state of being mounted on (connected to) a board. FIG. 5 is an exploded perspective view of the electrical connector according to the embodiment, and illustrates detailed configurations of an insulating spacer and a shell. FIG. 5 illustrates the developed shell, and the electrical connector in a state before assembly. FIG. 6 is a perspective view illustrating the configurations of the electrical connector and a counterpart connector according to the embodiment, and illustrates the electrical connector and the counterpart connector in a state before being mated together.

Firstly, an example of the configuration of the electrical connector according to the embodiment is described with reference to FIG. 1. As illustrated in FIG. 1, the electrical connector according to the embodiment is used as, for example, a board-side connector (receptacle connector) 1. The board-side connector 1 is mounted on a board 2 being, for example, a printed wiring board. The board-side connector 1 includes an insulating spacer 10 containing an insulating material such as resin, a shell 20 that contains a conductive material such as metal, and covers at least a part of the insulating spacer 10, and a plurality of (10 in FIG. 1) terminals 30 that is held by the insulating spacer 10. The shell 20 is formed by blanking a metal plate and bending the blank. The insulating spacer 10, together with the terminals 30, is formed by, for example, integral molding or insert molding.

The insulating spacer 10 includes a mating protruding portion 11 in the front in a mating direction (a direction $Y_2$), and a base portion 12. The base portion 12 has a shape where a bottom portion toward the back in the mating direction (a direction $Y_1$) expands in a connector width direction (directions $X_1$ and $X_2$). The mating protruding portion 11 is in a space (a mating space 21) surrounded by the shell 20. Contact portions 31 of the plurality of terminals 30 are provided, aligned along side surfaces of the mating protruding portion 11. In FIG. 1, a total of 10 terminals 30 are provided on both side surfaces of the mating protruding portion 11.

The shell 20 includes the mating space (mating recess) 21, lock holes 22, a fixing portion 23, base portion supports 24, and four mounting portions 25 and 26. The mating space 21 is provided inside the front in the mating direction (the direction $Y_2$). The lock hole 22 is provided in each of the top and bottom of the mating space 21. The fixing portion 23 is provided to the back in the mating direction (the direction $Y_1$). The base portion supports 24 have a shape that expands in the connector width direction (the direction $X_1$ or $X_2$) at the bottom toward the back in the mating direction (the direction $Y_1$). The mounting portions 25 and 26 extend in a board direction (a direction $Z_2$) in a lower part.

The mating space (mating recess) 21 is a space where a shell of a cable-side connector 5 (refer to FIG. 6) as the counterpart connector is mated, and is a space into which a terminal of the cable-side connector 5 is inserted. The lock hole 22 is a hole for engaging with a latch piece of the cable-side connector 5 and locking the cable-side connector 5 upon mating to the cable-side connector 5. When the insulating spacer 10 and the shell 20 are assembled together, the insulating spacer 10 is inserted into the shell 20, and then a basal portion 44 of the fixing portion 23 is bent; accordingly, the insulating spacer 10 is fixed to the shell 20. In other words, the fixing portion 23 is for fixing the insulating spacer 10 to prevent the insulating spacer 10 from coming out of the shell 20.

The base portion supports 24 located toward the back in the mating direction (the direction $Y_1$) have a shape that holds the base portion 12 of the insulating spacer 10. The mounting portion 25 extends from a distal end of the base portion support 24 toward the board 2. Moreover, distal end portions on the mating side (the direction $Y_2$) on both sides of the shell 20 are bent outward to form folded portions 28. The mounting portion 26 extends from a distal end portion of the folded portion 28 toward the board 2. A bent portion (protrusion) 27 that is bent in such a manner as to protrude outward in the connector width direction (the direction $X_1$ or $X_2$) is formed between the mounting portion 26 and the folded portion 28. Two mounting portions 25 located toward the back (the direction $Y_1$) and two mounting portions 26 located on the mating side (the direction $Y_2$) are inserted into four corresponding through-holes 3 formed in the board 2, respectively. The two mounting portions 25 and the two mounting portions 26 are fixed to and electrically connected to the board 2 by injecting solder into the through-holes 3.

When the board-side connector 1 is mounted on the board 2, the mounting portions 26 are inserted into the through-holes 3 in the board 2, and then solder is injected into the through-holes 3. Consequently, the board-side connector 1 is fixed to the board 2 to obtain a board with an electrical connector where the board-side connector 1 is mounted. At this point in time, if a gap between an outer wall 45 of the shell 20 and the mounting portion 26 is narrow, the melted solder may rise along the mounting portion 26 due to a capillary phenomenon. In this case, the amount of the solder in the through-hole is reduced; accordingly, mounting stiffness is reduced, and the solder is wasted. Therefore, the bent portion (protrusion) 27 that prevents the rise of the melted solder is provided between the mounting portion 26 and the folded portion 28. A space is formed between the bent portion (protrusion) 27 and the outer wall 45 of the shell 20; accordingly, a capillary phenomenon is prevented, and the rise of the melted solder is prevented.

The plurality of terminals 30 each includes the contact portion 31 that contacts the terminal of the cable-side connector 5, and a board connection portion 32 (refer to FIG. 3) that is connected to a circuit on the board 2. In FIG. 1, the number of the terminals 30 is 10. However, this is simply an example, and the number of the terminals 30 is not limited to 10, and can be any number. The contact portions 31 are provided in such a manner as to be aligned at predetermined intervals along a direction perpendicular to the board (a direction $Z_1$ and the direction $Z_2$) on both sides of the mating protruding portion 11 of the insulating spacer 10 in the connector width direction (the directions $X_1$ and $X_2$). The contact portions 31 are in the mating space 21. Upon mating to the cable-side connector 5, each terminal 30 and each terminal of the cable-side connector 5 come into contact with each other to be electrically connected to each other. Moreover, the board connection portion 32 is provided to each terminal 30 in the back of the terminal 30 in the mating direction (the direction $Y_1$). The board connection portion 32 is exposed from the insulating spacer 10, and extends toward the back in the mating direction (the direction $Y_1$). The board connection portions 32 are placed at predetermined intervals in the connector width direction (the directions $X_1$ and $X_2$). The board connection portion 32 is soldered and electrically connected to the circuit pattern on the board 2.

Moreover, the board connection portions 32 of the terminals 30 are densely packed, and the intervals between the board connection portions 32 are narrow. Hence, a coating is applied onto the board connection portions 32 to prevent a short between the terminals 30. The coating is an insulating material, and is applied with, for example, a spray or brush. The coating includes resin, and is solidified after being applied. Spacing between the board surface and the connector is generally narrow. Hence, when the coating is applied onto the board connection portion 32, the coating may move along the spacing; as a result, the coating may flow into the mating space of the connector. If the coating flows into the mating space of the connector, the adhesion of the coating to the contact portion of the terminal and a buildup of the coating in the mating space may cause a contact failure or a mating failure. Hence, the board-side connector 1 being the electrical connector of the embodiment is provided with a mechanism that prevents the coating from flowing into the mating space.

Next, the mechanism that prevents the coating from flowing into the mating space (mating recess) 21 is described with reference to FIGS. 2 to 5. FIG. 2 is a front view illustrating the configuration of the board-side connector (receptacle) 1. FIG. 3 is a cross-sectional view of a section taken along A-A in FIG. 2. FIG. 4 is a partial enlarged view of FIG. 3. FIG. 5 is an exploded perspective view of the board-side connector (receptacle) 1, and illustrates the detailed configurations of the insulating spacer 10 and the shell 20. FIG. 5 illustrates the developed shell, and the board-side connector 1 in a state before assembly.

As illustrated in FIGS. 3 to 5, the insulating spacer 10 includes a mating space wall portion 16 configuring the mating space 21 between the board connection portion 32 and the contact portion 31 of the terminal 30. Moreover, the insulating spacer 10 includes a cavity 13 for preventing the inflow of the coating along an undersurface 17 (refer to FIG. 5) facing the board 2 (for example, stopping, blocking, or cutting off the flow of the coating, or reducing the amount of the coating flowing in), in the undersurface 17 between the board connection portion 32 and the mating space wall portion 16. The cavity 13 has a shape of a notch (a notch provided in the undersurface 17 of the insulating spacer 10) along the connector width direction (the directions $X_1$ and $X_2$). The shape of the cavity 13 is not limited to the notch and may be another shape such as a semicylindrical or polygonal prism shape. In other words, the cavity 13 is simply required to be formed in such a manner that a distance between a surface 2*a* of the board 2 (or a board-side inner surface 20*a* of the shell 20) and an undersurface 17*a* of the cavity 13 (the insulating spacer 10) is wide.

The cavity 13 is provided along the entire length in the connector width direction (the directions $X_1$ and $X_2$) to prevent the inflow of the coating. After the board-side connector 1 is mounted on the board 2, the coating such as liquid resin is applied onto the board connection portions 32 to improve insulation between the terminals 30. At this point in time, the coating may flow in a direction indicated by an arrow 6 along the surface of the board 2 as illustrated in FIG. 4. In this case, a gap between the surface of the board 2 and the undersurface 17 is narrow; accordingly, it is conceivable that a capillary phenomenon causes the coating to move from the board connection portion 32 toward the mating space (the direction $Y_2$) through between the surface of the board 2 and the undersurface 17. However, in the embodiment, the presence of the cavity 13 prevents (or blocks) a capillary phenomenon. Consequently, it is possible to prevent the coating from flowing from the board connection portion 32 into the mating space 21. Moreover, the mating space wall portion 16 also prevents the inflow of the coating. As illustrated in FIG. 4, the cavity 13 has a space that is sufficiently spacious to prevent a capillary phenomenon. Moreover, the cavity 13 is sufficiently spacious to absorb the coating. In FIG. 4, the board-side inner surface 20*a* of the shell 20 is present under the cavity 13. In terms of this, the board-side inner surface 20*a* of the shell 20 may not be present under the cavity 13.

Moreover, as illustrated in FIGS. 3 to 5, the insulating spacer 10 includes a plurality of (two in the embodiment) protruding traps 14 and 15 for causing the coating to adhere thereto, between the board connection portion 32 and the cavity 13 on the undersurface 17 facing the board 2. In the embodiment, the traps 14 and 15 are formed in such a manner as to have a protruding shape extending in the connector width direction (the directions $X_1$ and $X_2$). Moreover, in the embodiment, the traps 14 and 15 are provided in two places in the mating direction (the directions $Y_1$ and $Y_2$). The trap 14 located on the back side (the board connection portion side or the direction $Y_1$ side) in the mating direction (the directions $Y_1$ and $Y_2$) is longer in the connector width direction than the trap 15 located on the front side (the cavity side or the direction $Y_2$ side) in the mating direction. Such a configuration allows most of the coating that moves from the board connection portion 32 to the mating space (the direction $Y_2$) to adhere to the trap 14. The shape of the traps 14 and 15 is not limited to a protruding shape and may be a recessed shape. Moreover, in the embodiment, the traps 14 and 15 have a cuboid shape. In terms of this, the shape of the traps 14 and 15 is not limited to a cuboid shape and may be another shape such as a semicylindrical or polygonal prism shape. Moreover, the coating can also build up between the traps 14 and 15. In this manner, the protruding or recessed traps 14 and 15 are provided to the undersurface 17 to increase the surface area of a portion of the undersurface 17 in the middle between the board connection portion 32 and the mating space 21. The adhesion of the coating to this portion allows a reduction in the amount of the coating moving to the cavity 13. Moreover, the number of the traps 14 and 15 is two in the embodiment, but may be one, or three or more.

Next, the detailed configurations of the insulating spacer 10 and the shell 20 are described with reference to FIG. 5. FIG. 5 is an exploded perspective view of the board-side connector 1 according to the embodiment, and illustrates the detailed configurations of the insulating spacer 10 and the shell 20. FIG. 5 illustrates the developed shell 20, and the board-side connector 1 in a state before assembly. As illustrated in FIG. 5, the insulating spacer 10 includes a press-fitting protruding portion 18 on each of both sides around the center toward the back in the mating direction (the direction $Y_1$). The press-fitting protruding portion 18 includes a chamfer 19 at a distal end thereof on the mating side (the direction $Y_2$). Moreover, the shell 20 includes press-fitted recessed portions 29 at positions corresponding to the press-fitting protruding portions 18. The press-fitted recessed portion 29 includes a press-fitting projection 41 protruding inward. The press-fitting projection 41 includes an inclined surface at the back in the mating direction (the direction $Y_1$).

When the insulating spacer 10 and the shell 20 are assembled together, the mating protruding portion 11 of the insulating spacer 10 is moved to the front in the mating direction (the direction $Y_2$), and inserted into the mating space 21 of the shell 20. Furthermore, the press-fitting protruding portions 18 are press-fitted into the press-fitted recessed portions 29 to join the insulating spacer 10 and the shell 20. At this point in time, the press-fitting protruding portion 18 includes the chamfer 19 at the distal end on the mating side (the direction $Y_2$), and the press-fitting projection 41 is inclined (includes the inclined surface) on the $Y_1$ side. Accordingly, press-fitting is easy. After the insulating spacer 10 and the shell 20 are jointed together, distal ends of the press-fitting projections 41 dig into side portions of the press-fitting protruding portions 18. Hence, the insulating spacer 10 resists coming out of the shell 20. Moreover, the press-fitting protruding portion 18 and the press-fitted recessed portion 29 also serve for positioning and as a guide at the time of the joint. After the insulating spacer 10 and the shell 20 are joined together, the fixing portion 23 of the shell 20 is bent downward in the direction perpendicular to the board (the direction $Z_2$). Consequently, the insulating spacer 10 is enclosed by and fixed to the shell 20. At this point in time, engagement protruding portions 42 on side surfaces of the shell 20 are engaged with engagement holes 43 in the fixing portion 23. Consequently, the joint of the insulating spacer 10 and the shell 20 becomes firm. The engagement protruding portion 42 is inclined, and accordingly is easily engaged with the engagement hole 43. On the other hand, it is difficult to cancel the engagement of the engagement protruding portion 42 and the engagement hole 43.

Next, the configuration of the counterpart connector is described with reference to FIG. 6. FIG. 6 is a perspective view illustrating the configurations of the cable-side connector (plug). As illustrated in FIG. 6, the counterpart connector is, for example, the cable-side connector (plug) 5. A cable 4 is connected to the cable-side connector 5. The cable-side connector 5 includes a shell 51 containing a conductive material such as metal, a housing 52 containing an insulating material such as rein, lock operating portions 53 that can elastically move up and down, and lock pieces 54 that can elastically move up and down. The shell 51 is provided on the mating side (the direction $Y_1$). Terminals (not illustrated) as many as the terminals 30 of the board-side connector 1 are provided inside the shell 51. The contact portion 31 of the terminal 30 of the board-side connector 1 and the terminal of the cable-side connector 5 come into contact with each other when the board-side connector 1 and the cable-side connector 5 are mated together. Consequently, the terminals thereof are electrically connected to electrically connect the circuit on the board 2 and a signal wire of the cable 4.

Moreover, the shell 51 includes a lock piece-specific hole 55 in each of the top and bottom thereof. The lock piece 54 protrudes from the lock piece-specific hole 55. The lock piece 54 is inclined (includes an inclined surface) on the mating side (the direction $Y_1$). When the board-side connector 1 and the cable-side connector 5 are mated together, the shell 51 is inserted into the mating space 21 of the shell 20. At this point in time, since the lock pieces 54 are inclined on the mating side (the direction $Y_1$), the shell 51 inserted into the mating space 21 of the shell 20 continues being pressed in the mating direction (the direction $Y_1$), and the lock pieces 54 move inward due to elasticity. Consequently, the board-side connector 1 and the cable-side connector 5 are easily mated together. The elasticity allows the lock pieces 54 to return outward, and the lock pieces 54 are engaged with and locked in the lock holes 22. When the lock is cancelled, a pair of the lock operating portions 53 is pressed inward (the directions $Z_1$ and $Z_2$) to hold the lock pieces 54. Consequently, the lock pieces 54 are moved inward in conjunction with the holding of the lock pieces 54 to cancel the lock. As a result, it is easy to cancel the mating of the connectors.

As described above, according to the electrical connector of the embodiment, it is possible to prevent the entrance of the coating to the mating space of the connector along the undersurface when the coating is applied to the board connection portion of the terminal. Consequently, it is possible to prevent the coating from adhering to the terminal contact portion and to the mating space; accordingly, the reliability of the electrical connector is improved.

Up to this point, the technology developed by the inventors has been specifically described on the basis of the embodiment thereof. Needless to say, however, the technology of the present disclosure is not limited to the above embodiment, and can be modified in various manners without departing from the gist thereof.

The technology of the present disclosure can be used for electronic equipment such as mobile information terminals and personal computers.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An electrical connector which includes:

an insulating spacer formed including an insulating material;

a shell formed including a conductive material, the shell being configured to cover at least a part of the insulating spacer; and a plurality of terminals configured to be held by the insulating spacer, wherein each of the plurality of terminals includes a contact portion that contacts a terminal of a counterpart connector, and a board connection portion that is connected to a circuit on a board where the electrical connector is mounted, the insulating spacer includes a cavity for preventing the inflow of a coating along a surface facing the board, between the board connection portion and the contact portion in the surface facing the board, the shell includes a mating space for mating to a part of the counterpart connector, the cavity has an opening facing downward, and the opening of the cavity is facing toward an inner surface of the shell.

2. The electrical connector according to claim 1, wherein the contact portion is present in the mating space, the board connection portion extends from the insulating spacer, and the cavity is configured to prevent the inflow of the coating from the board connection portion into the mating space.

3. The electrical connector according to claim 1, wherein the cavity has a shape of a notch provided in the surface of the insulating spacer, the surface facing the board.

4. The electrical connector according to claim 1, wherein the insulating spacer includes a protruding or recessed trap for causing the coating to adhere thereto, between the board connection portion and the cavity on the surface facing the board.

5. The electrical connector according to claim 4, wherein a plurality of the traps is formed on the surface of the insulating spacer, the surface facing the board, the plurality of the traps has a shape extending in a connector width direction, and the trap located on the board connection portion side is longer in the connector width direction than the trap located on the cavity side.

6. A board with an electrical connector where the electrical connector according to claim 1 is mounted.

7. An electrical connector which includes:

an insulating spacer formed including an insulating material;

a shell formed including a conductive material, the shell being configured to cover at least a part of the insulating spacer; and a plurality of terminals configured to be held by the insulating spacer, wherein each of the plurality of terminals includes a contact portion that contacts a terminal of a counterpart connector, and a board connection portion that is connected to a circuit on a board where the electrical connector is mounted, the insulating spacer includes a cavity for preventing the inflow of a coating along a surface facing the board, between the board connection portion and the contact portion in the surface facing the board, and the insulating spacer includes a protruding or recessed trap for causing the coating to adhere thereto, between the board connection portion and the cavity on the surface facing the board.

8. The electrical connector according to claim 7, wherein the shell includes a mating space for mating to a part of the counterpart connector, the contact portion is present in the mating space, the board connection portion extends from the insulating spacer, and the cavity is configured to prevent the inflow of the coating from the board connection portion into the mating space.

9. The electrical connector according to claim 7, wherein the cavity has a shape of a notch provided in the surface of the insulating spacer, the surface facing the board.

10. The electrical connector according to claim 7, wherein a plurality of the traps is formed on the surface of the insulating spacer, the surface facing the board, the plurality of the traps has a shape extending in a connector width direction, and the trap located on the board connection portion side is longer in the connector width direction than the trap located on the cavity side.

11. A board with an electrical connector where the electrical connector according to claim 7 is mounted.

* * * * *